US009574579B2

(12) United States Patent
Dybing

(10) Patent No.: US 9,574,579 B2
(45) Date of Patent: Feb. 21, 2017

(54) MULTIPLE FLUID PUMP COMBINATION CIRCUIT

(75) Inventor: Philip J. Dybing, Canton, MN (US)

(73) Assignee: Eaton Corporation, Cleveland, OH (US)

( * ) Notice: Subject to any disclaimer, the term of this patent is extended or adjusted under 35 U.S.C. 154(b) by 1225 days.

(21) Appl. No.: 13/095,613

(22) Filed: Apr. 27, 2011

(65) Prior Publication Data

US 2011/0283691 A1 Nov. 24, 2011

Related U.S. Application Data

(60) Provisional application No. 61/330,060, filed on Apr. 30, 2010.

(51) Int. Cl.
*F15B 11/17* (2006.01)

(52) U.S. Cl.
CPC ..... *F15B 11/17* (2013.01); *F15B 2211/20576* (2013.01); *F15B 2211/30585* (2013.01); *F15B 2211/327* (2013.01); *F15B 2211/71* (2013.01)

(58) Field of Classification Search
CPC ..... F15B 11/162; F15B 11/17; F15B 13/022; F15B 2211/20576; F15B 2211/781; E02F 9/2242; E02F 9/2292
USPC ..... 60/421, 422, 429; 91/516
See application file for complete search history.

(56) References Cited

U.S. PATENT DOCUMENTS 2,979,908 A * 4/1961 Shook ..... 91/28
3,443,380 A * 5/1969 Karazija ..... 60/421
3,900,075 A 8/1975 Chichester et al.
3,962,954 A 6/1976 Jacob et al.
4,044,786 A * 8/1977 Yip ..... 137/101
4,141,280 A 2/1979 Lorimor et al.
4,210,061 A 7/1980 Bianchetta
4,340,086 A * 7/1982 Hemm et al. ..... 137/554
4,383,412 A 5/1983 Presley
(Continued)

FOREIGN PATENT DOCUMENTS

CN 1356223 A 7/2002
DE 10354022 A1 * 6/2004
(Continued)

OTHER PUBLICATIONS

DE 10354022 English machine translation from espacenet. 2014.*
(Continued)

*Primary Examiner* — Michael Leslie
*Assistant Examiner* — Michael Quandt
(74) *Attorney, Agent, or Firm* — Merchant & Gould P.C.

(57) ABSTRACT

A method of combining outputs of a plurality of fluid pumps includes receiving an input signal from an input device. The input signal is adapted to control a function of a work vehicle. An actuation signal is sent to a first direction control device of a first actuator assembly. The first actuator assembly is in selective fluid communication with a first pump assembly. A position of a second direction control valve of a second actuator assembly is received. The second actuator assembly is in selective fluid communication with a second pump assembly. A selector valve that is in fluid communication with a cavity of a poppet valve assembly is actuated so that the second pump assembly is in fluid communication with the first actuator assembly when the second direction control valve is in a neutral position.

14 Claims, 5 Drawing Sheets

(56) References Cited

U.S. PATENT DOCUMENTS

| | | | | |
|---|---|---|---|---|
| 4,395,878 | A | 8/1983 | Morita Koichi et al. | |
| 4,537,029 | A * | 8/1985 | Gunda et al. | 60/390 |
| 4,759,183 | A * | 7/1988 | Kreth et al. | 60/422 |
| 4,768,339 | A * | 9/1988 | Aoyagi | E02F 9/2242 60/427 |
| 4,811,561 | A * | 3/1989 | Edwards et al. | 60/368 |
| 4,986,072 | A | 1/1991 | Kubomoto | |
| 5,148,676 | A * | 9/1992 | Moriya et al. | 60/429 |
| 5,261,232 | A | 11/1993 | Maffini et al. | |
| 5,615,553 | A | 4/1997 | Lourigan et al. | |
| 5,673,558 | A * | 10/1997 | Sugiyama et al. | 60/426 |
| 5,692,377 | A * | 12/1997 | Moriya et al. | 60/421 |
| 5,826,676 | A * | 10/1998 | Ko | 180/403 |
| 5,829,252 | A * | 11/1998 | Hirata | E02F 9/2242 60/421 |
| 5,852,934 | A * | 12/1998 | Chung et al. | 60/421 |
| 5,946,910 | A | 9/1999 | Hayashi et al. | |
| 6,145,287 | A | 11/2000 | Rosskopf | |
| 7,162,869 | B2 * | 1/2007 | Yoshino | 60/414 |
| 7,331,175 | B2 * | 2/2008 | VerKuilen et al. | 60/429 |
| 7,412,315 | B2 * | 8/2008 | Wildey et al. | 701/41 |
| 7,604,300 | B2 * | 10/2009 | Whitfield et al. | 298/22 C |
| 7,832,208 | B2 * | 11/2010 | Peterson et al. | 60/431 |
| 7,849,689 | B2 | 12/2010 | Sakakura et al. | |
| 2008/0296083 | A1 | 12/2008 | Krieger | |
| 2009/0056324 | A1 * | 3/2009 | Itakura et al. | 60/421 |
| 2009/0282824 | A1 | 11/2009 | Ando et al. | |
| 2013/0000293 | A1 | 1/2013 | Dybing | |

FOREIGN PATENT DOCUMENTS

| | | | |
|---|---|---|---|
| EP | 2 261 427 | A1 | 12/2010 |
| FR | 2010953 | | 2/1970 |
| FR | 2 659 699 | A1 | 9/1991 |
| GB | 2 339 033 | A | 1/2008 |
| JP | 2003246239 | | 9/2003 |
| JP | 2007276418 | A | 10/2007 |
| JP | 2007278430 | A | 10/2007 |
| WO | WO 2005/024246 | A1 | 3/2005 |

OTHER PUBLICATIONS

International Search Report and Written Opinion mailed Aug. 29, 2011.

International Search Report and Written Opinion dated Jan. 7, 2013 cited in Application No. PCT/US2012/044888: 9 pgs.

* cited by examiner

MULTIPLE FLUID PUMP COMBINATION CIRCUIT

CROSS REFERENCE TO RELATED APPLICATIONS

The present application claims the benefit of U.S. Provisional Patent Application Ser. No. 61/330,060, entitled Multiple Fluid Pump Combination Circuit and filed on Apr. 30, 2010, the disclosure of which is hereby incorporated by reference in its entirety.

BACKGROUND

Fluid systems used in various applications often have pumps that are sized to provide fluid to various fluid circuits in the fluid system. The sizing of the pumps is typically based on the limitations of the fluid devices receiving the fluid. This approach often leads to pumps having large displacements.

SUMMARY

An aspect of the present disclosure relates to an actuator system. The actuator system includes a first actuator assembly, a first pump assembly in fluid communication with the first actuator assembly, a second actuator assembly, and a second pump assembly in selective fluid communication with the second actuator assembly. The second actuator assembly includes a direction control valve having a closed center neutral position. The actuator system further includes a pump combiner assembly adapted to provide fluid from the second pump assembly to the first actuator when the direction control valve is in the neutral position. The pump combiner assembly includes a first fluid inlet in fluid communication with the first pump assembly, a second fluid inlet in fluid communication with the second pump assembly, a first fluid outlet in fluid communication with the first actuator assembly, a second fluid outlet in fluid communication with the second actuator assembly, a poppet valve assembly and a selector valve. The poppet valve assembly includes a poppet valve. The poppet valve assembly defines a valve bore having a valve seat that is disposed between the second fluid inlet and the first fluid outlet. The poppet valve has a first axial end adapted for contact with the valve seat and a second axial end. The valve bore and the second axial end of the poppet valve cooperatively define a cavity. A selector valve in fluid communication with the cavity of the poppet valve assembly. The selector valve is electronically actuated between a first position in which the cavity is in fluid communication with a fluid reservoir and a second positioning which the cavity is in fluid communication with the fluid inlet.

Another aspect of the present disclosure relates to an actuator system. The actuator system includes a first actuator assembly, a first pump assembly in fluid communication with the first actuator assembly, a second actuator assembly, a first pump assembly, and a second pump assembly in selective fluid communication with the second actuator assembly. The first actuator assembly includes a first direction control valve in fluid communication with a first actuator. The second actuator assembly includes a direction control valve having a closed center neutral position. The actuator system further includes a pump combiner assembly adapted to provide fluid from the second pump assembly to the first actuator when the direction control valve is in the neutral position. The pump combiner assembly includes a first fluid inlet in fluid communication with the first pump assembly, a second fluid inlet in fluid communication with the second pump assembly, a first fluid outlet in fluid communication with the first actuator assembly, a second fluid outlet in fluid communication with the second actuator assembly, a poppet valve assembly and a selector valve. The poppet valve assembly includes a poppet valve. The poppet valve assembly defines a valve bore having a valve seat that is disposed between the second fluid inlet and the first fluid outlet. The poppet valve has a first axial end adapted for contact with the valve seat and a second axial end. The valve bore and the second axial end of the poppet valve cooperatively define a cavity. A selector valve in fluid communication with the cavity of the poppet valve assembly. The selector valve is electronically actuated between a first position in which the cavity is in fluid communication with a fluid reservoir and a second positioning which the cavity is in fluid communication with the fluid inlet. An electronic control unit is in electrical communication with the selector valve and the first direction control valve.

Another aspect of the present disclosure relates to a method of combining outputs of a plurality of fluid pumps. The method includes receiving an input signal from an input device. The input signal is adapted to control a function of a work vehicle. An actuation signal is sent to a first direction control device of a first actuator assembly. The first actuator assembly is in selective fluid communication with a first pump assembly. A position of a second direction control valve of a second actuator assembly is received. The second actuator assembly is in selective fluid communication with a second pump assembly. A selector valve that is in fluid communication with a cavity of a poppet valve assembly is actuated so that the second pump assembly is in fluid communication with the first actuator assembly when the second direction control valve is in a neutral position.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
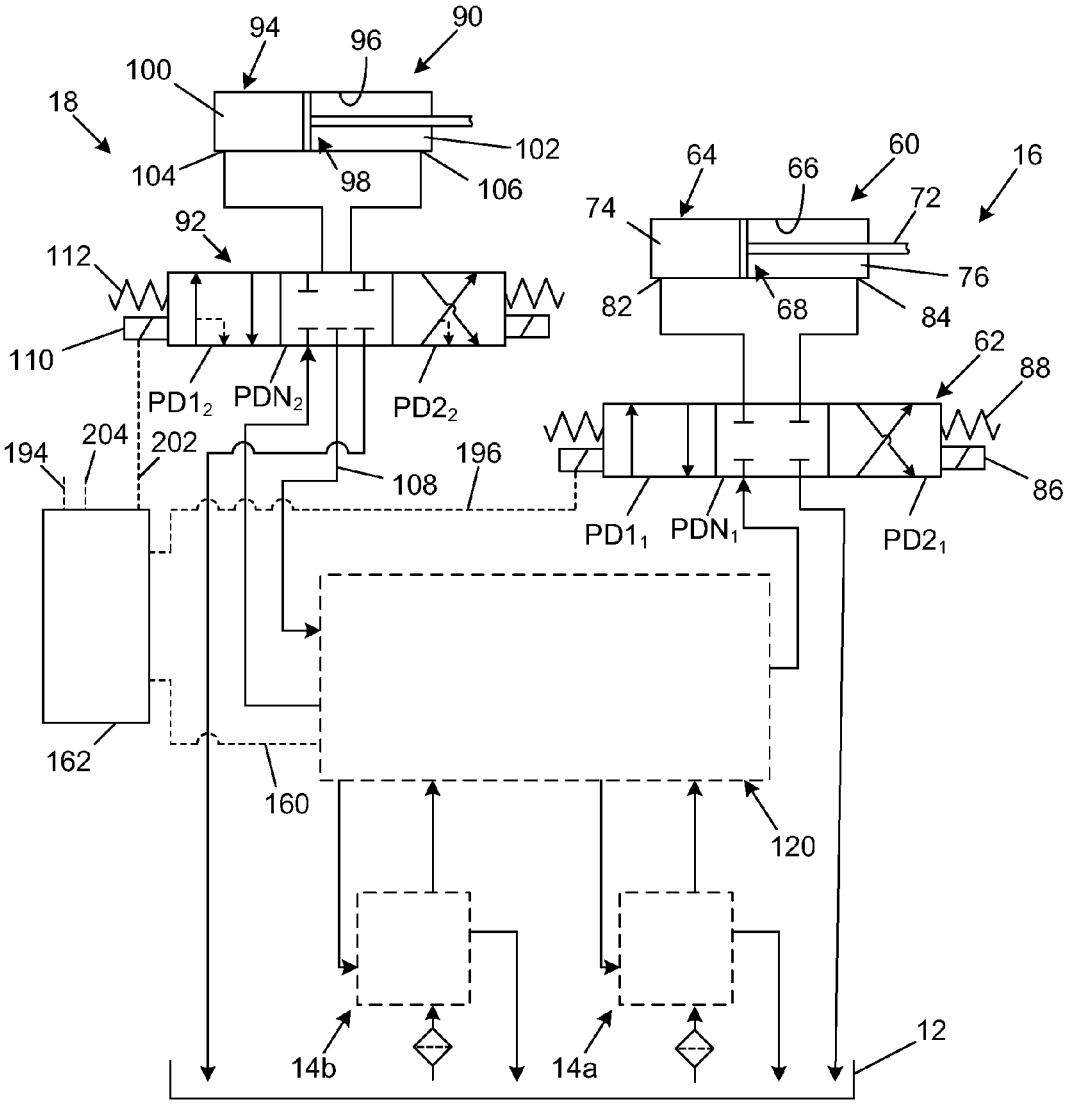
FIG. 1 is a schematic representation of an actuator system having exemplary features of aspects in accordance with the principles of the present disclosure.

Referring now to FIG. 1, an actuator system 10 is shown. The actuator system 10 includes a fluid reservoir 12, a first fluid pump assembly 14*a* in fluid communication with the fluid reservoir 12, a second fluid pump assembly 14*b* in fluid communication with the fluid reservoir 12, a first actuator assembly 16 in fluid communication with the first fluid pump assembly 14*a* and a second actuator assembly 18 in fluid communication with the second fluid pump assembly 14*b*.

Figure 2:
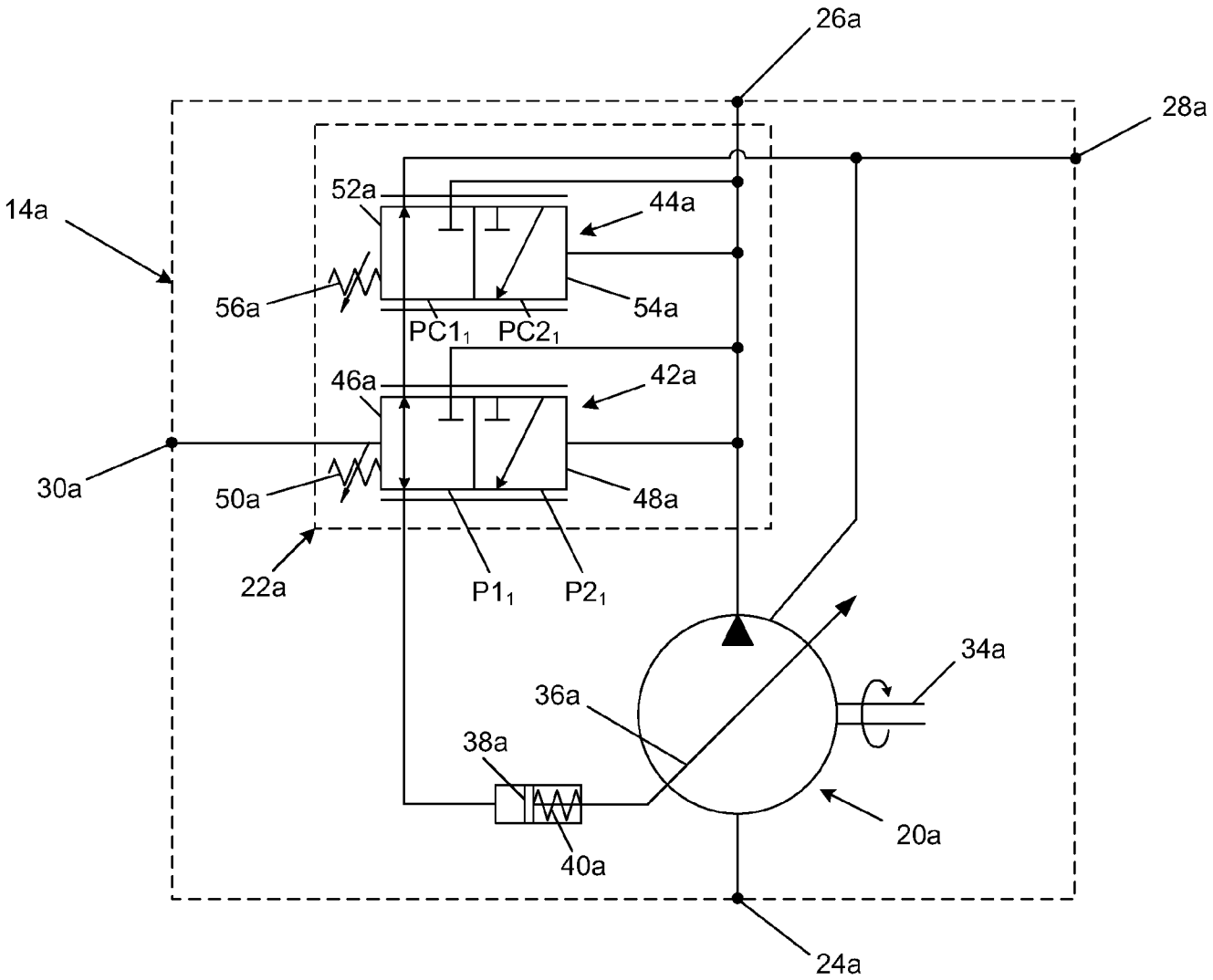
FIG. 2 is a schematic representation of a fluid pump assembly suitable for use with the actuator system of FIG. 1.

Referring now to FIGS. 1 and 2, the first and second fluid pump assemblies 14*a*, 14*b* will be described. In one embodiment, the first and second pump assemblies 14*a*, 14*b* are disposed in a tandem configuration.

In the depicted embodiment, features of the first and second pump assemblies 14*a*, 14*b* are substantially similar. For ease of description purposes, only the first pump assembly 14*a* will be described in detail. As the features of the first and second pump assemblies 14*a*, 14*b* are substantially similar, features of the second pump assembly 14*b* will have the same reference numeral as the same feature of the first pump assembly 14*a* except that the reference numeral for the feature of the second pump assembly 14*b* will include a "b" at the end of the reference numeral instead of an "a." The first fluid pump assembly 14*a* includes a first fluid pump 20*a* and a first load sensing compensator 22*a*.

The first fluid pump 20*a* includes a fluid inlet 24*a*, a fluid outlet 26*a*, a drain port 28*a* and a load sense port 30*a*. The fluid inlet 24*a* of the first fluid pump 20*a* is in fluid communication with the fluid reservoir 12. The fluid outlet 26*a* is in fluid communication with the first actuator assembly 16. The drain port 28*a* is in fluid communication with the fluid reservoir 12.

The first fluid pump 20*a* further includes a shaft 34*a*. The shaft 34*a* is coupled to a power source (e.g., an engine, electric motor, etc.) that rotates the shaft 34*a*. As the shaft 34*a* rotates, fluid is pumped from the fluid inlet 24*a* to the fluid outlet 26*a*.

The first fluid pump 20*a* is a variable displacement fluid pump. As a variable displacement pump, the first fluid pump 20*a* includes a variable displacement mechanism 36*a*. In the depicted embodiment, the first fluid pump 20*a* is an axial piston pump and the variable displacement mechanism 36*a* is a swash plate. The swash plate 36*a* is movable between a neutral position and a full stroke position. In the neutral position, the displacement of the first fluid pump 20*a* is about zero. At zero displacement, no fluid passes through the first fluid pump 20*a* as the shaft 34*a* rotates. In the full stroke position, a maximum amount of fluid passes through the first fluid pump 20*a* as the shaft 34*a* rotates.

The first fluid pump 20*a* includes a control piston 38*a* and a biasing member 40*a*. The control piston 38 and the biasing member 40*a* act against the swash plate 36*a* to adjust the position of the swash plate 36*a*. The control piston 38*a* is adapted to adjust the position of the swash plate 36*a* from the full stroke position to the neutral position. The control piston 38*a* is in selective fluid communication with the fluid outlet 26*a* of the first fluid pump 20*a*. The control piston 38*a* is in fluid communication with the first load sensing compensator valve assembly 22*a*.

The biasing member 40*a* is adapted to bias the first fluid pump 20*a* toward the full stroke position. The biasing member 40*a* includes a spring that biases swash plate 36*a* toward the full stroke position.

The first load sensing compensator valve assembly 22*a* is adapted to vary the flow of fluid and the pressure of the fluid from the first fluid pump 20*a* as the flow and pressure requirements of the system employing the first fluid pump 20*a* vary. In the depicted embodiment, the first load sensing compensator valve assembly 22*a* includes a load sense valve 42*a* and a pressure limiting compensator 44*a*. In one embodiment, the first load sensing compensator valve assembly 22*a* is external to the first fluid pump 20*a*. In another embodiment, the first load sensing compensator valve assembly 22*a* is integral to the first fluid pump 20*a*.

The load sensing valve 42*a* provides selective fluid communication between the control piston 38*a* and either the drain port 28*a* or the fluid outlet 26*a* of the first fluid pump 20*a*. In the depicted embodiment, the load sensing valve 42*a* is a proportional two-position, three-way valve. In a first position $P1_1$, the load sensing valve 42*a* provides fluid communication between the control piston 38*a* and the drain port 28*a* so that fluid acting against the control piston 38*a* is drained to the fluid reservoir 12 through the drain port 28*a*. With the load sensing valve 42*a* in this first position $P1_1$, the swash plate 36*a* is biased toward the full stroke position by the biasing member 40*a*.

In a second position $P2_1$, the load sensing valve 42*a* provides fluid communication between the control piston 38*a* and the fluid outlet 26*a* so that pressurized fluid acts against the control piston 38*a*. With the load sensing valve 42*a* in this second position $P2_1$, the control piston 38*a* acts against the biasing member 40*a* to move the swash plate 36*a* toward the neutral position.

The load sensing valve 42*a* includes a first end 46*a* and an oppositely disposed second end 48*a*. The first end 46*a* is in fluid communication with the load sense port 30*a*. Fluid from the load sense port 30*a* acts against the first end 46*a* to actuate the load sensing valve 42*a* to the first position $P1_1$. In the depicted embodiment, a light spring 50*a* also acts against the first end 46*a* of the load sensing valve 42*a* to bias the load sensing valve 42*a* to the first position $P1_1$. In one embodiment, the combined load against the first end 46*a* of the load sensing valve 42*a* is equal to the pressure of the fluid from the load sensing port 30*a* plus about 200 psi to about 400 psi.

The second end 48*a* of the load sensing valve 42*a* is in fluid communication with the fluid outlet 26*a* of the first fluid pump 20*a*. When the fluid pressure acting on the second end 48*a* is greater than the fluid pressure acting on the first end 46*a*, the control piston 38*a* actuates the swash plate 36*a* in a direction toward the neutral position, thereby decreasing the amount of fluid displaced by the first fluid pump 20*a*.

The pressure limiting compensator 44*a* is a type of pressure relieving valve. In the depicted embodiment, the pressure limiting compensator 44*a* is a proportional two-position, three-way valve. The pressure limiting compensator 44*a* includes a first end 52*a* and an oppositely disposed second end 54*a*. A heavy spring 56*a* acts against the first end 52*a* of the pressure limiting compensator 44*a* while fluid from the fluid outlet 26*a* acts against the second end 54*a*.

The pressure limiting compensator 44*a* includes a first position $PC1_1$ and a second position $PC2_1$. In the first position $PC1_1$, the pressure limiting compensator 44*a* provides a fluid passage to the drain port 28*a*. When the pressure limiting compensator 44*a* is in the first position $PC1_1$ and the load sensing valve 42*a* is in the first position $P1_1$, fluid acting against the control piston 38*a* is drained to the fluid reservoir 12 through the drain port 28*a*. With the pressure limiting compensator 44*a* in this first position $PC1_1$ and the load sensing valve 42*a* in the first position $P1_1$, the swash plate 36*a* is biased toward the full stroke position by the biasing member 40*a*.

In the second position $PC2_1$, the pressure limiting compensator 44*a* provides fluid communication between the control piston 38*a* and the fluid outlet 26*a* so that pressurized fluid acts against the control piston 38*a*. With the pressure limiting compensator 44*a* in this second position $PC2_1$, the control piston 38*a* acts against the biasing member 40*a* to move the swash plate 36*a* toward the neutral position.

As fluid pressure in the fluid outlet 26*a* rises and approaches a load setting of the heavy spring 56*a*, the pressure limiting compensator 44*a* shifts toward the second position $PC2_1$ allowing fluid to pass to the control piston 38*a*. As fluid acts against the control piston 38*a*, the position of the swash plate 36*a* is moved toward the neutral position. This movement continues until the amount of fluid at the fluid outlet 26*a* of the first fluid pump 20*a* is low enough to maintain the system pressure at the load setting of the heavy spring 56*a*or until the first fluid pump 20*a* is in the neutral position. In one embodiment, the heavy spring 56 provides a load setting of about 2500 psi to about 3500 psi system pressure.

Referring again to FIG. 1, the first actuator assembly 16 and the second actuator assembly 18 will be described. The first actuator assembly 16 includes a first actuator 60 and a first direction control valve 62.

The first actuator 60 can be a linear actuator (e.g., a cylinder, etc.) or a rotary actuator (e.g., a motor, etc.). In the subject embodiment, the first actuator 60 is a linear actuator. The first actuator 60 includes a housing 64 that defines a bore 66. A piston assembly 68 is disposed in the bore 66. The piston assembly 68 includes a piston 70 and a rod 72. The bore 66 includes a first chamber 74 and a second chamber 76. The first chamber is disposed on a first side of the piston 70 while the second chamber 76 is disposed on an oppositely disposed second side of the piston 70.

The first actuator 60 includes a first control port 82 and a second control port 84. The first control port 82 is in fluid communication with the first chamber 74 while the second control port 84 is in fluid communication with the second chamber 76.

The first direction control valve 62 is in fluid communication with the first actuator 60. In the depicted embodiment, the first direction control valve 62 is a three-position, four-way valve. The first direction control valve 62 includes a first position $PD1_1$, a second position $PD2_1$ and a closed center neutral position $PDN_1$.

In the first position, the first direction control valve 62 provides fluid communication between the first fluid pump 20*a* and the first control port 82 and between the second control port 84 and the fluid reservoir 12. In the depicted embodiment, the first position $PD1_1$ results in extension of the piston assembly 68 from the housing 64. In the second position $PD2_1$, the first direction control valve 62 provides fluid communication between the first fluid pump 20*a* and the second control port 84 and between the first control port 82 and the fluid reservoir 12. In the depicted embodiment, the second position $PD2_1$ results in retraction of the piston assembly 68.

In the depicted embodiment, the first direction control valve 62 is actuated by a first plurality of solenoid valves 86. A first plurality of centering springs 88 is adapted to bias the first direction control valve 62 to the neutral position $PN1_1$.

The second actuator assembly 18 includes a second actuator 90 and a second direction control valve 92. The second actuator includes a housing 94 defining a bore 96. A piston assembly 98 is disposed in the bore 96. The piston assembly 98 separates the bore 96 into a first chamber 100 and a second chamber 102.

The housing 94 includes a first control port 104 in fluid communication with the first chamber 100 and a second control port 106 in fluid communication with the second chamber 102.

The second direction control valve 92 is in fluid communication with the second actuator 90. In the depicted embodiment, the second direction control valve 92 is a three-position, five-way valve. The second direction control valve 92 includes a first position $PD1_2$, a second position $PD2_2$ and a closed center neutral position $PDN_2$.

In the first position $PD1_2$, the second direction control valve 92 provides fluid communication between the fluid outlet 26*b* of the second fluid pump 20*b* and the first control port 104 and between the second control port 106 and the fluid reservoir 12. The second direction control valve 92 also provides fluid communication between the fluid outlet 26*b* and a load sense path 108, which is in fluid communication with the load sense port 30*b* of the second fluid pump 20*b*. In the depicted embodiment, the first position $PD1_1$ results in extension of the piston assembly 98 from the housing 94.

In the second position $PD2_2$, the second direction control valve 92 provides fluid communication between the second fluid pump 20*b* and the second control port 106 and between the first control port 104 and the fluid reservoir 12. The second direction control valve 92 also provides fluid communication between the fluid outlet 26*b* and the load sense path 108, which is in fluid communication with the load sense port 30*b* of the second fluid pump 20*b*. In the depicted embodiment, the second position $PD2_2$ results in retraction of the piston assembly 98.

In the depicted embodiment, the second direction control valve 92 is actuated by a second plurality of solenoid valves 110. A second plurality of centering springs 112 is adapted to bias the second direction control valve 92 to the neutral position $PN1_2$.

Figure 3:
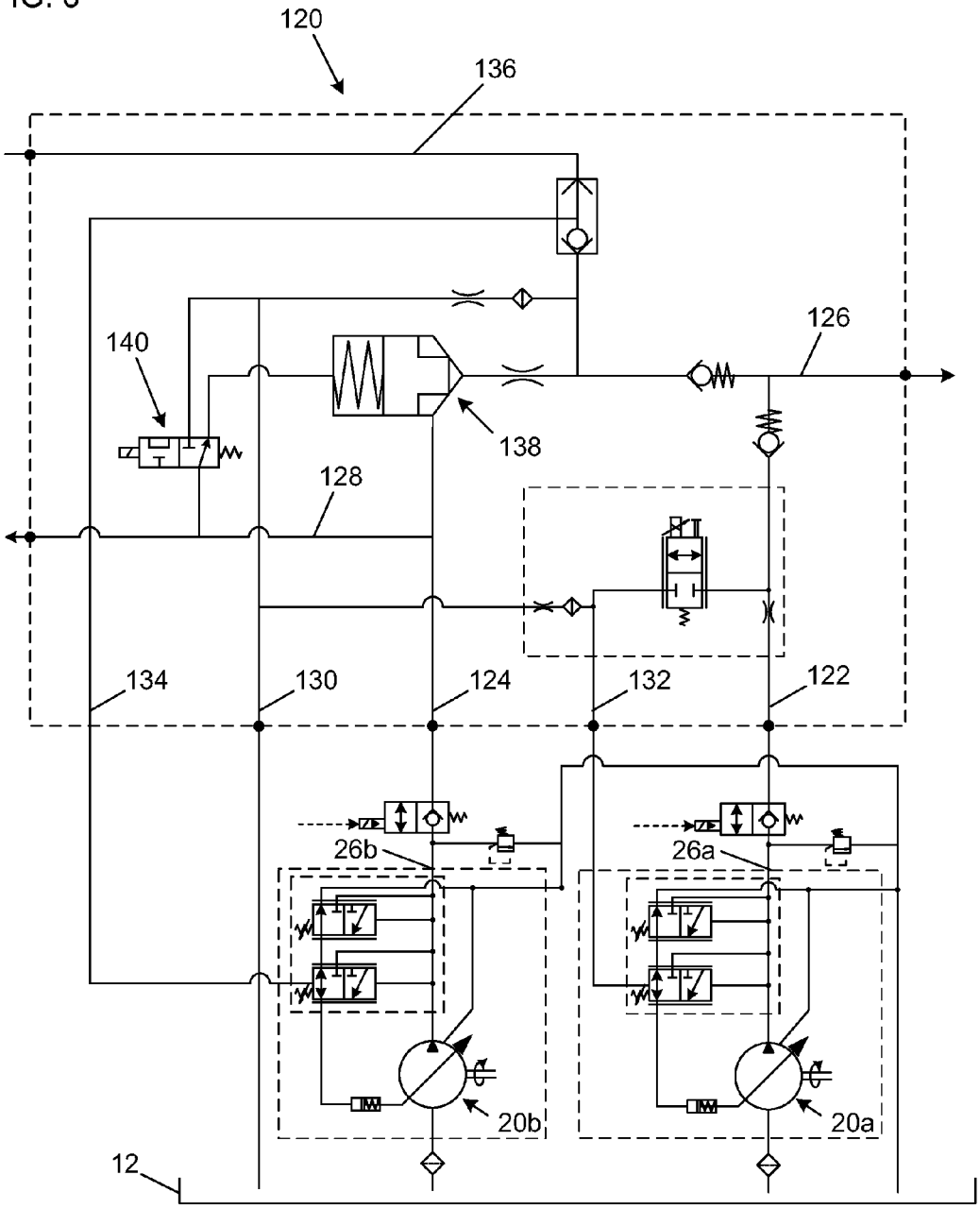
FIG. 3 is a schematic representation of a pump combiner assembly and the fluid pump assembly.
Figure 4:
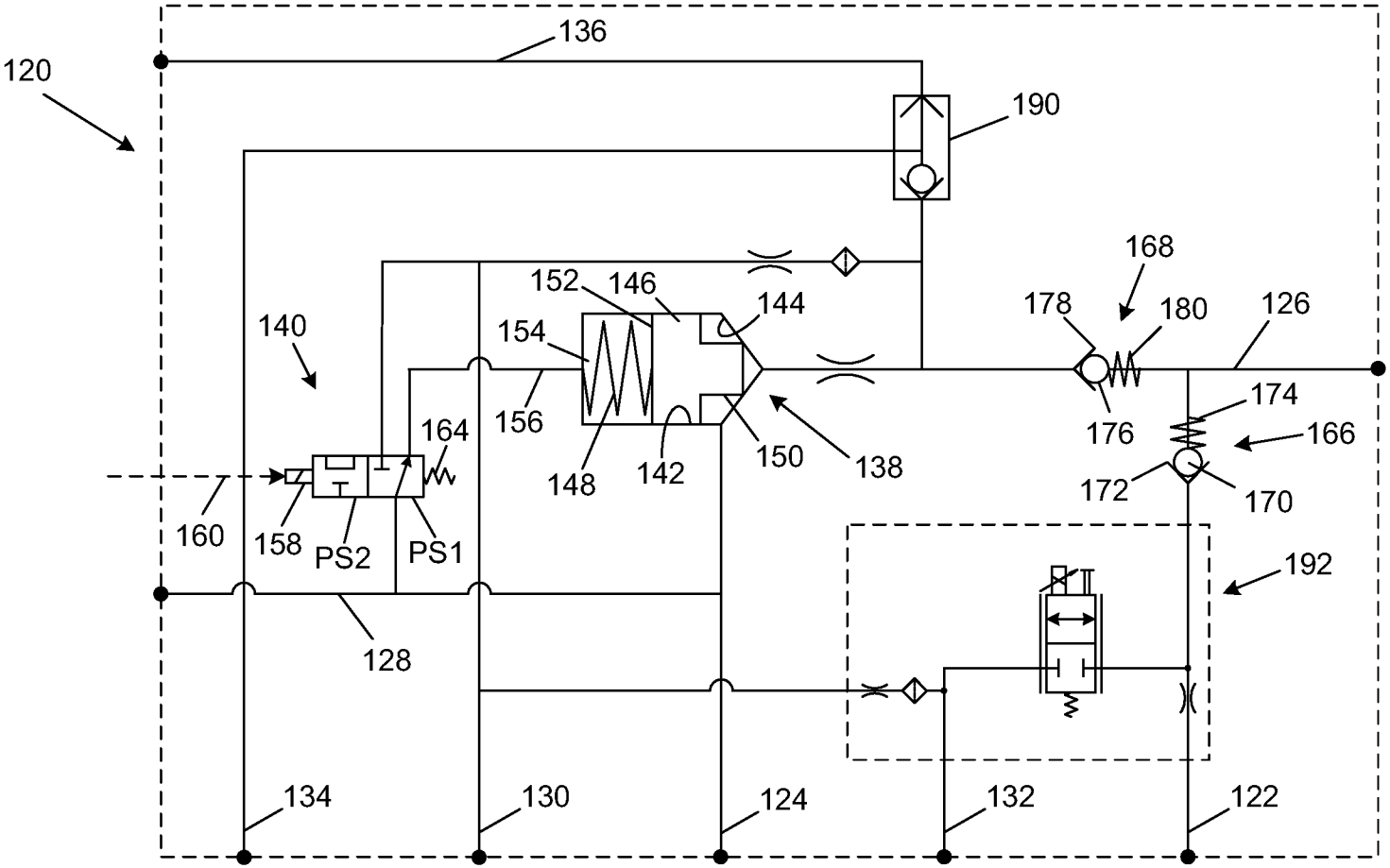
FIG. 4 is a schematic representation of the pump combiner assembly of FIG. 3.

Referring now to FIGS. 1, 3 and 4, the actuator system 10 further includes a pump combiner assembly 120. The pump combiner assembly 120 includes first and second modes of operation. In the first mode, the pump combiner assembly 120 provides fluid communication between the first pump assembly 14*a* and the first actuator assembly 16 and between the second pump assembly 14*b* and the second actuator assembly 18. In the first mode, fluid communication between the first pump assembly 14*a* and the second fluid actuator assembly 18 is blocked.

In the second mode, the pump combiner assembly 120 is adapted to combine fluid from the first and second pump assemblies 14*a*, 14*b*. In this mode, the pump combiner assembly 120 combines fluid from the fluid outlet 26*a* of the first fluid pump 20*a* and the fluid outlet 26*b* of the second fluid pump 20*b* and communicates that combined fluid to the second actuator assembly 18.

In the depicted embodiment, the pump combiner assembly 120 includes a first inlet passage 122 that is in fluid communication with the fluid outlet 26*a* of the first pump assembly 14*a*, a second inlet passage 124 that is in fluid communication with the fluid outlet 26*b* of the second pump assembly 14*b*, a first outlet passage 126 that is in fluid communication with the first actuator assembly 16 and a second outlet passage 128 that is in fluid communication with the second actuator assembly 18. The pump combiner assembly 120 further includes a return passage 130 that is in fluid communication with the fluid reservoir 12. In the depicted embodiment, the pump combiner assembly 120 includes a first load sense passage 132 that is in fluid communication with the load sense port 30*a* of the first pump assembly 12*a*, a second load sense passage 134 that is in fluid communication with the load sense port 30*b* of the second pump assembly 12*b* and a third load sense passage 136 that is in fluid communication with the load sense path 108 of the second direction control valve 92.

The pump combiner assembly 120 includes a poppet valve assembly 138 and a selector valve 140. The poppet valve assembly 138 defines a valve bore 142. The second inlet passage 124 and the first outlet passage 126 are in fluid communication with the valve bore 142. The valve bore 142 includes a valve seat 144 disposed between the second inlet passage 124 and the first outlet passage 126.

The poppet valve assembly 138 includes a poppet valve 146 that is slidably disposed in the valve bore 142 and a spring 148. The poppet valve 146 has a first axial end 150 and an oppositely disposed second axial end 152. The first axial end 150 is adapted for selective engagement with the valve seat 144. The second axial end 152 of the poppet valve 146 and the valve bore 142 cooperatively define a spring cavity 154. The spring 148 is disposed in the spring cavity 154 and acts against the second axial end 152 of the poppet valve 146 to bias the poppet valve 146 into engagement with the valve seat 144. When the poppet valve 146 is in a seated position, the first axial end 150 sealingly abuts the valve seat 144 so that fluid communication between the second inlet passage 124 and the first outlet passage 126 is blocked. When the poppet valve 146 is in an unseated position, the first axial end 150 is axially displaced from the valve seat 144 so that fluid is communicated between the second inlet passage 124 and the first outlet passage 126.

The poppet valve assembly 138 further includes a spring cavity passage 156. The spring cavity passage 156 is in fluid communication with the spring cavity 154.

The selector valve 140 is in fluid communication with the spring cavity 154. The selector valve 140 is adapted to selectively drain fluid from the spring cavity 154 so that fluid is communicated from the second inlet passage 124 to the first outlet passage 126.

In the depicted embodiment, the selector valve 140 is a two position, three-way valve. In a first position PS1, the selector valve 140 provides fluid communication between the second outlet passage 128 of the pump combiner assembly 120 and the spring cavity 154 so that fluid in the second outlet passage 128 flows into the spring cavity 154. With fluid from the second outlet passage 128 communicated to the spring cavity 154, the first axial end 150 of the poppet valve 146 abuts the valve seat 144 of the valve bore 142 so that fluid communication between the second inlet passage 124 and the first outlet passage 126 is blocked. With fluid communication between the second inlet passage 124 and the first outlet passage 126 blocked, only fluid from the first pump assembly 14*a* is communicated to the first actuator assembly 16.

In a second position PS2, the selector valve 140 provides fluid communication between the spring cavity 154 and the return passage 130. In this second position PS2, fluid in the spring cavity 154 is drained to the fluid reservoir 12. Fluid from the second inlet passage 124 acting on the first axial end 150 of the poppet valve 146 unseats the poppet valve 146 from the valve seat 144 in the valve bore 142 so that fluid from the second inlet passage 124 is communicated to the first outlet passage 126. With the poppet valve 146 in the unseated position, fluid from the first pump assembly 14*a* and fluid from the second pump assembly 14*b* are communicated to the first actuator assembly 16.

In the depicted embodiment, the selector valve 140 includes a solenoid 158. When in an energized state, the solenoid 158 actuates the selector valve 140 to the second position PS2. The solenoid 158 actuates the selector valve 140 in response to a power signal 160 from an electronic control unit 162 (shown in FIG. 1). A spring 164 biases the selector valve 140 to the first position PS1 when the solenoid 158 is in an unenergized state.

The pump combiner assembly 120 further includes a first one-way valve assembly 166 and a second one-way valve assembly 168. The first one-way valve assembly 166 is disposed in the first inlet passage 122. The first one-way valve assembly 166 is adapted to allow fluid to flow from the first pump assembly 14*a* to the first actuator assembly 16 and to prevent fluid from flowing in an opposite direction (i.e., from the first actuator assembly 16 to the first pump assembly 14*a*). The first one-way valve assembly 166 also prevents the flow of fluid from the second pump assembly 14*b* to the first pump assembly 14*a*.

In one embodiment, the first one-way valve assembly 166 includes a check valve 170 and a check valve seat 172. The check valve 170 is biased into contact with the check valve seat 172 by a spring 174. When the check valve 170 is in contact with the check valve seat 172, fluid communication between the first outlet passage 126 and the first inlet passage 122 is blocked. When the pressure of the fluid in the first outlet passage 126 is greater than or equal to the pressure of the fluid in the first inlet passage 122, the check valve 170 is moved into contact with the check valve seat 172.

The second one-way valve assembly 168 is disposed in the first outlet passage 126. The second one-way valve assembly 168 is adapted to allow fluid to flow from the poppet valve assembly 138 to the first actuator assembly 16 and to prevent fluid from flowing in an opposite direction (i.e., from the first actuator assembly 16 to the poppet valve assembly 138). The second one-way valve assembly 168 also prevents fluid from flowing from the first pump assembly 12*a* to the poppet valve assembly 138.

In one embodiment, the second one-way valve assembly 168 includes a second check valve 176 and a second check seat 178. The second check valve 176 is biased into contact with the second check valve seat 178 by a spring 180. When the second check valve 176 is in contact with the second check valve seat 178, fluid communication between the first actuator assembly 16 and the poppet valve assembly 138 is blocked.

The pump combiner assembly 120 further includes a shuttle 190. The shuttle 190 is in fluid communication with the second load sense passage 134, which is in fluid communication with the load sense port 30*b* of the second pump assembly 14*b*. The shuttle 190 compares the pressure of the fluid from the third load sense passage 136 and the pressure of the fluid in the first outlet passage 126 between the poppet valve assembly 138 and the second one-way valve assembly 168. The fluid at the higher pressure is communicated to the load sense port 30*b* of the second pump assembly 14*b* through the shuttle valve 190.

In the depicted embodiment, the pump combiner assembly 120 includes a ramping valve assembly 192. The ramping valve assembly 192 is adapted to control the fluid output of the first fluid pump 20*a* based on the position of the first actuator 60 of the first actuator assembly 16. The ramping valve assembly 192 has been described in U.S. patent application Ser. No. 12/770,261, entitled "Control of a Fluid Pump Assembly" and filed on Apr. 29, 2010, which is hereby incorporated by reference in its entirety.

Figure 5:
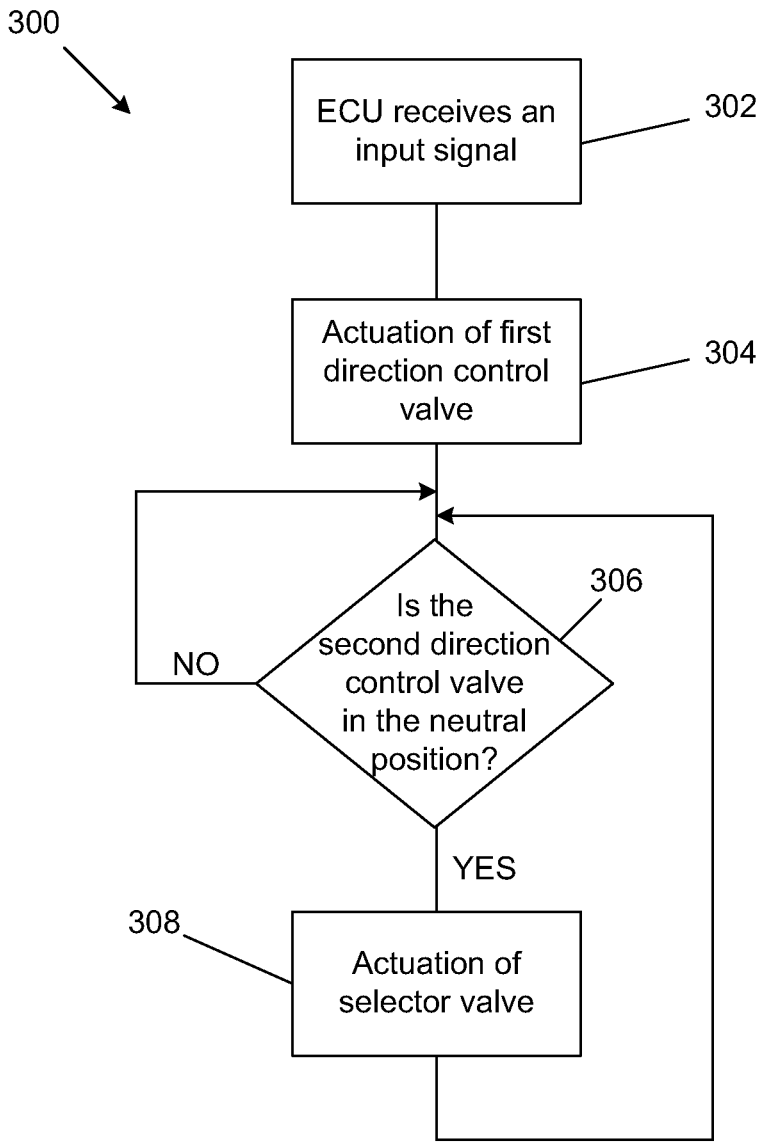
FIG. 5 is a representation of a method for combining outputs of a plurality of fluid pumps.

Referring now to FIG. 5, a method 300 for combining outputs of a plurality of fluid pumps will be described. In step 302, an input signal 194 is received by the electronic control unit 162. In one embodiment, the input signal 194 is provided by an operator using an input device (e.g., joystick, steering wheel, etc.) that is adapted to control a function of a work vehicle (e.g., refuse truck, skid steer loader, backhoe, excavator, tractor, etc.).

In response to the signal 194, the electronic control unit 162 sends an actuation signal 196 to the first actuation assembly 16 in step 304. The actuation signal 196 is received by the solenoid valve 86 of the first direction control valve 62. In response to the actuation signal 196, the solenoid valve 86 actuates the first direction control valve 62 to one of the first and second positions $PD1_1$, $PD2_1$. With the first direction control valve 62 in one of the first and second positions $PD1_1$, $PD2_1$, fluid from the first pump assembly 12*a* is communicated to the first actuator 60.

In step 306, the electronic control unit 162 evaluates the position of the second direction control valve 92 of the second actuator assembly 18. If the second direction control valve 92 is in the neutral position $PDN_2$, the electronic control unit 162 sends the power signal 160 to the solenoid 158 of the selector valve 140 in step 308. In response to the power signal 160, the selector valve 140 is actuated to the second position PS2 so that fluid in the spring cavity 154 is drained to the fluid reservoir 12. With the fluid in the spring cavity 154 drained to the fluid reservoir 12, the poppet valve 146 is unseated from the valve seat 144 of the valve bore 142. With the poppet valve 146 unseated from the valve seat 144, the fluid from the second pump assembly 14*b* is communicated to the first actuator 60 of the first actuator assembly 16.

In the depicted embodiment, fluid from the first pump assembly 14*a* and fluid from the second pump assembly 14*b* are combined in the first outlet passage 126 of the pump combiner assembly 120 when the selector valve 140 is actuated to the second position PS2. The first outlet passage 126 is then communicated to the first actuator assembly 16.

In the event that the electronic control unit 162 receives a second input signal 200, which is provided by the operator and is adapted to control a second function of the work vehicle, the electronic control unit 162 stops sending the power signal 160 to the solenoid 158 of the selector valve 140 so that the selector valve 140 is biased back to the first position PS1, in which fluid is communicated to the spring cavity 154 of the valve bore 142. With fluid communicated to the spring cavity 154, fluid communication between the second inlet passage 124 and the first outlet passage 126 is blocked. The electronic control unit 162 then sends a second actuation signal 202 to the second direction control valve 92 of the second actuator assembly 18 to actuate the second direction control valve 92 to one of the first and second positions $PD1_2$, $PD2_2$.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. An actuator system comprising:

a first actuator assembly including a first directional control valve in fluid communication with a first actuator;

a first pump assembly in fluid communication with the first actuator assembly;

a second actuator assembly having a second direction control valve in fluid communication with a second actuator, the second direction control valve having a closed center neutral position;

a second pump assembly in selective fluid communication with the second actuator; and a pump combiner assembly adapted to combine fluid from the second pump assembly and the first pump assembly, and provide the combined fluid to the first actuator when the direction control valve is in the neutral position, the pump combiner assembly including:

a first fluid inlet in fluid communication with the first pump assembly;

a second fluid inlet in fluid communication with the second pump assembly;

a first fluid outlet in fluid communication with the first actuator assembly;

a second fluid outlet in fluid communication with the second actuator assembly;

a poppet valve assembly including a poppet valve and defining a valve bore having a valve seat, the valve seat being disposed between the second fluid inlet and the first fluid outlet, the poppet valve having a first axial end adapted for contact with the valve seat and a second axial end, the valve bore and the second axial end of the poppet valve cooperatively defining a cavity;

a one-way valve assembly disposed between the poppet valve assembly and the first fluid outlet, the one-way valve assembly preventing fluid from flowing from the first actuator assembly to the poppet valve assembly a shuttle valve in fluid communication with a second pump assembly load sense port, the shuttle valve comparing fluid pressure from the second pump assembly at a location of the second direction control valve with fluid pressure from the second pump assembly at a location between the poppet valve assembly and the one-way valve assembly, the shuttle valve communicating the higher pressure to the second pump assembly load sense port, and a selector valve in fluid communication with the cavity of the poppet valve assembly, the selector valve being electronically actuated between a first position in which the cavity is in fluid communication with a fluid reservoir and a second position in which the cavity is in fluid communication with the second fluid inlet, wherein the actuator system operates in a first mode in which:

the second direction control valve is not in the closed center neutral position;

the first pump assembly provides pressurized fluid for powering the first actuator assembly;

the second pump assembly provides pressurized fluid for powering the second actuator assembly;

the selector valve is in the second position; and the first axial end of the of the poppet valve contacts the valve seat, wherein the actuator system operates in a second mode in which:

the second direction control valve is in the closed center neutral position;

the first pump assembly provides pressurized fluid for powering the first actuator assembly;

the second pump assembly provides pressurized fluid for powering the first actuator assembly and does not provide pressurized fluid to the second actuator;

the selector valve is in the first position; and the first axial end of the of the poppet valve is offset from the valve seat, and wherein the first pump assembly is hydraulically isolated from the second actuator assembly in both the first and second modes so as to not provide pressurized hydraulic fluid to the second actuator assembly in either of the first and second modes.

2. The actuator system of claim 1, wherein the pump combiner assembly includes a second one-way valve assembly disposed between the first fluid inlet and the first fluid outlet, the second one-way valve assembly preventing fluid from flowing from the first actuator assembly to the first pump assembly.

3. The actuator system of claim 1, further comprising an electronic control unit in electrical communication with the selector valve.

4. The actuator system of claim 3, wherein the direction control valve of the second actuator assembly is actuated by a solenoid.

5. The actuator system of claim 4, wherein the electronic control unit is in electrical communication with the solenoid of the direction control valve of the second actuator assembly.

6. An actuator system comprising:

a first actuator assembly having a first direction control valve in fluid communication with a first actuator;

a first pump assembly in fluid communication with the first actuator assembly;

a second actuator assembly having a second direction control valve in fluid communication with a second actuator, the second direction control valve having a closed center neutral position;

a second pump assembly in selective fluid communication with the second actuator;

a pump combiner assembly adapted to combine fluid from the second pump assembly and the first pump assembly, and provide the combined fluid to the first actuator when the second direction control valve is in the neutral position, the pump combiner assembly including:

a first fluid inlet in fluid communication with the first pump assembly;

a second fluid inlet in fluid communication with the second pump assembly;

a first fluid outlet in fluid communication with the first actuator assembly;

a second fluid outlet in fluid communication with the second actuator assembly;

a poppet valve assembly including a poppet valve and defining a valve bore having a valve seat, the valve seat being disposed between the second fluid inlet and the first fluid outlet, the poppet valve having a first axial end adapted for contact with the valve seat and a second axial end, the valve bore and the second axial end of the poppet valve cooperatively defining a cavity;

a one-way valve assembly disposed between the poppet valve assembly and the first fluid outlet, the one-way valve assembly preventing fluid from flowing from the first actuator assembly to the poppet valve assembly a shuttle valve in fluid communication with a second pump assembly load sense port, the shuttle valve comparing fluid pressure from the second pump assembly at a location of the second direction control valve with fluid pressure from the second pump assembly at a location between the poppet valve assembly and the one-way valve assembly, the shuttle valve communicating the higher pressure to the second pump assembly load sense port, a selector valve in fluid communication with the cavity of the poppet valve assembly, the selector valve being electronically actuated between a first position in which the cavity is in fluid communication with a fluid reservoir and a second position in which the cavity is in fluid communication with the second fluid inlet; and an electronic control unit in electrical communication with the selector valve and the first direction control valve, wherein the actuator system operates in a first mode in which:

the second directional control valve is not in the closed center neutral position;

the first pump assembly provides pressurized fluid for powering the first actuator assembly;

the second pump assembly provides pressurized fluid for powering the second actuator assembly;

the selector valve is in the second position; and the first axial end of the of the poppet valve contacts the valve seat, wherein the actuator system operates in a second mode in which:

the second directional control valve is in the closed center neutral position;

the first pump assembly provides pressurized fluid for powering the first actuator assembly;

the second pump assembly provides pressurized fluid for powering the first actuator assembly and does not provide pressurized fluid to the second actuator assembly;

the selector valve is in the first position; and the first axial end of the of the poppet valve is offset from the valve seat, and wherein the first pump assembly is hydraulically isolated from the second actuator assembly in both the first and second modes so as to not provide pressurized hydraulic fluid to the second actuator assembly in either of the first and second modes.

7. The actuator system of claim 6, wherein the pump combiner assembly includes a second one-way valve assembly disposed between the first fluid inlet and the first fluid outlet, a second one-way valve assembly preventing fluid from flowing from the first actuator assembly to the first pump assembly.

8. The actuator system of claim 1, wherein the second direction control valve of the second actuator assembly is actuated by a solenoid.

9. The actuator system of claim 8, wherein the electronic control unit is in electrical communication with the solenoid of the second direction control valve of the second actuator assembly.

10. A method for combining outputs of a plurality of fluid pumps, the method comprising:

receiving an input signal from an input device, the input signal being adapted to switch a work vehicle from a first mode to a second mode, wherein in the first mode a first pump assembly provides pressurized fluid for powering a first actuator assembly, a second direction control valve of a second actuator assembly is not in a closed center neutral position, a second pump assembly provides pressurized fluid for powering the second actuator assembly, a selector valve that is fluid communication with a cavity of a poppet valve assembly is in a position where the fluid from the first pump assembly is directed to the first actuator assembly and the fluid from the second pump assembly is directed to the second actuator assembly, sending an actuation signal to a first direction control device of the first actuator assembly to switch the work vehicle to the second mode, wherein in the second mode the second direction control valve is in the closed center neutral position, the selector valve is in fluid communication with the cavity of the poppet valve assembly such that the first pump assembly provides pressurized fluid for powering the first actuator assembly and the second pump assembly provides pressurized fluid for powering the first actuator assembly and does not provide pressurized fluid to the second actuator assembly, wherein the first pump assembly is hydraulically isolated from the second actuator assembly in both the first and second modes so as to not provide pressurized hydraulic fluid to the second actuator assembly in either of the first and second modes; and comparing fluid pressure from the second pump assembly at a location of the second direction control valve with fluid pressure from the second pump assembly at a location between a first fluid outlet of the poppet valve assembly and a one-way valve assembly that prevents fluid from flowing from the first actuator assembly to the poppet valve assembly, and communicating the higher pressure to the second pump assembly load sense port.

11. The method of claim 10, wherein a second one-way valve assembly prevents fluid from flowing from the first actuator assembly to the first pump assembly.

12. The method of claim 11, wherein the second direction control valve includes a solenoid.

13. The method of claim 10, further comprising sending an actuation signal to the direction control valve when a second input signal is received, the second input signal being adapted to control a second function of the work vehicle.

14. The method of claim 10, wherein the first direction control valve includes a solenoid.

* * * * *